US006151037A

United States Patent [19]

Kaufman et al.

[11] Patent Number: 6,151,037

[45] Date of Patent: Nov. 21, 2000

[54] PRINTING APPARATUS

[75] Inventors: Jeffrey R. Kaufman, Vernon Hills; Jack LeVan, Barrington; Clive Hohberger, Gurnee; Larry Ancahas, Glencoe, all of Ill.

[73] Assignee: Zebra Technologies Corporation, Vernon Hills, Ill.

[21] Appl. No.: 09/034,443

[22] Filed: Mar. 4, 1998

Related U.S. Application Data

[60] Provisional application No. 60/070,809, Jan. 8, 1998.

[51] Int. Cl.[7] ..... B41J 3/00; B41J 2/01

[52] U.S. Cl. ..... 347/2; 347/104; 347/171

[58] Field of Search ..... 347/49, 40, 16, 347/2, 171, 104, 101; 400/120.01, 82, 149, 150; 399/43, 2; 271/3.03, 3.01

[56] References Cited

U.S. PATENT DOCUMENTS

| | | | |
|---|---|---|---|
| Re. 32,572 | 1/1988 | Hawkins et al. | 216/27 |
| 3,889,592 | 6/1975 | Lupkas et al. | 101/93.47 |
| 4,591,884 | 5/1986 | Miyamoto et al. | 347/153 |
| 4,774,530 | 9/1988 | Hawkins | 347/63 |
| 4,803,500 | 2/1989 | Milbrandt | 347/49 |

(List continued on next page.)

FOREIGN PATENT DOCUMENTS

| | | |
|---|---|---|
| 0227483 | 7/1987 | European Pat. Off. . |
| 0361780 | 4/1990 | European Pat. Off. . |
| 60-110456 | 6/1985 | Japan . |
| 1123381 | 5/1989 | Japan . |
| 02303843 | 12/1990 | Japan . |
| 03176177 | 7/1991 | Japan . |
| 2322597 | 9/1998 | United Kingdom . |

*Primary Examiner*—John Barlow
*Assistant Examiner*—J. Stephens
*Attorney, Agent, or Firm*—Trexler, Bushnell, Giangiorgi & Blackstone, Ltd.

[57] ABSTRACT

A printing apparatus, having a housing in which a thermal transfer printhead station and an ink jet printhead station are mounted, is used for printing indica on a medium, such as tickets, tags and the like. The thermal transfer printhead station is used for printing a monochrome colored indicia on the print medium and the ink jet printhead station is used for printing a single monochrome colored indicia or a plurality of monochrome colored indicia on the print medium. A decoupling station is mounted between the thermal transfer printhead station and the ink jet printhead station for accumulating print medium therein. A sensor is associated with the decoupling station for sensing the amount of print medium accumulated therein. In use, the print medium is passed through the thermal transfer printhead station and a monochrome colored indicia is printed thereon. Thereafter, the print medium is accumulated in the decoupling station and when a predetermined amount of print medium is accumulated therein, the print medium is passed to the ink jet printhead station and a plurality of monochrome colored indicia may be printed thereon or a single monochrome colored indicia is printed thereon. The printed-on medium is thereafter ejected from the printing apparatus. A die cutting or severing structure may be provided for die cutting or severing the print medium.

26 Claims, 7 Drawing Sheets

U.S. PATENT DOCUMENTS

| | | | |
|---|---|---|---|
| 4,829,324 | 5/1989 | Drake et al. | 347/63 |
| 4,999,077 | 3/1991 | Drake et al. | 156/299 |
| 5,057,859 | 10/1991 | Ishimaru | 396/49 |
| 5,099,256 | 3/1992 | Anderson | 347/103 |
| 5,132,704 | 7/1992 | Nakagawa | 347/197 |
| 5,136,305 | 8/1992 | Ims | 347/7 |
| 5,138,336 | 8/1992 | Goto | 347/198 |
| 5,160,945 | 11/1992 | Drake | 347/42 |
| 5,192,959 | 3/1993 | Drake et al. | 347/42 |
| 5,198,054 | 3/1993 | Drake et al. | 156/64 |
| 5,221,397 | 6/1993 | Nystrom | 156/273.5 |
| 5,257,043 | 10/1993 | Kneezel | 347/42 |
| 5,270,738 | 12/1993 | Takahashi et al. | 347/24 |
| 5,280,308 | 1/1994 | Takahashi et al. | 346/134 |
| 5,321,467 | 6/1994 | Tanaka et al. | 399/2 |
| 5,330,274 | 7/1994 | Schimmelpfennig et al. | 400/82 |
| 5,343,227 | 8/1994 | Hirosawa et al. | 347/42 |
| 5,365,645 | 11/1994 | Walker et al. | 29/890.1 |
| 5,373,350 | 12/1994 | Taylor et al. | 347/3 |
| 5,398,053 | 3/1995 | Hirosawa et al. | 347/13 |
| 5,402,527 | 3/1995 | Bigby et al. | 358/1.1 |
| 5,444,469 | 8/1995 | Cowger | 347/15 |
| 5,561,500 | 10/1996 | Ohzeki et al. | 347/43 |
| 5,570,451 | 10/1996 | Sakaizawa et al. | 355/202 |
| 5,587,730 | 12/1996 | Karz | 347/43 |
| 5,592,262 | 1/1997 | Tanaka et al. | 347/3 |
| 5,710,582 | 1/1998 | Hawkins et al. | 347/42 |
| 5,734,390 | 3/1998 | Sakaizawa et al. | 347/2 |
| 5,748,204 | 5/1998 | Harrison | 347/2 |
| 5,833,232 | 11/1998 | Ifkovits et al. | 271/3.01 |
| 5,908,116 | 6/1999 | Levaro et al. | 271/3.03 |

PRINTING APPARATUS

ON-DEMAND MULTICOLOR PRINTER APPARATUS

This application is based on and claims the priority of provisional application Ser. No. 60/070,809 filed on Jan. 8, 1998.

BACKGROUND OF THE INVENTION

The present invention is generally directed to a novel on-demand printing apparatus capable of printing indicia, such as bar codes, text, graphics and the like, on a print medium, such as labels, tags, tickets and the like.

On-demand multicolor printers are well known in the prior art and are used in many applications to imprint a continuous print medium such as labels, tags and tickets. These applications include bar code printers, ticket printers and garment tag printers. In such printers, the print medium is conveyed through a print station and indicia is printed thereon as the print medium passes a printhead.

Such printing may be performed by a variety of printing techniques, such as impact, ink jet, laser, and thermal transfer printing. At the time of this disclosure, thermal transfer printing is the most widely used printing technology.

In a thermal transfer printing process, a thermally reactive ribbon is disposed between a thermal printhead and the print medium. The thermal printhead has a plurality of heating elements thereon that can be selectively energized. As the thermally reactive ribbon is heated, ink is transferred from the ribbon onto the print medium forming indicia thereon.

To print color, a plurality of thermal transfer print stations are concatenated together, as described in U.S. Pat. No. 5,675,369, wherein each thermal transfer print station contains a stationary printhead having a width at least as wide as the print medium being printed on. Each thermal transfer print station is actuatable for applying a monochromatic image to the print medium. The monochromatic image printed by each print station can be kept either separate or mixed together on the print medium allowing for a large gamut of colors to be printed on the print medium.

Ink jet printing utilizes a printhead having a plurality of ejection nozzles for ejecting ink onto a print medium to form indicia thereon. A prior art bubble jet printer manufactured by Canon®, which is similar to the color printer described in U.S. Pat. No. 5,675,360, replaces each thermal transfer print station with an ink jet print station. Each ink jet print station contains a stationary printhead having the approximate width of the print medium being imaged as well as associated printhead maintenance hardware and electronics.

There are advantages and disadvantages to each of two technologies listed above.

Thermal transfer printing technology generally yields the highest quality image especially when printing machine readable symbologies, such as bar codes. Thermal transfer technology also yields highly durable images, prints very fast, and is robust for harsh industrial printing environments.

Unfortunately, thermal transfer technology is extremely wasteful of ribbons, costly to run, and poor for the environment when printing multiple colors due to ribbon wastage. Ribbon saving means incorporated in these printers helps to decrease the amount of wasted ribbon however, depending on the format of the printed indica, prior art ribbon saving techniques may not be very effective. In addition, incorporating multiple thermal transfer print stations in a printer is very costly and, likewise, renders these types of printers much more expensive then their monochromatic counterparts that only require one thermal transfer print station.

Ink jet printing technology has the key advantage of efficiency. Ink jet printheads consume less power than thermal transfer printheads and only spray ink where required, eliminating generation of wasted ribbons and ink. Print speeds of printers incorporating stationary ink jet printheads, such as the Canon® printer described before, are approximately the same as thermal transfer printers, although, at least theoretically, the ink jet printers can print at much higher speeds.

The disadvantages of using ink jet technology in on-demand printers is the reliability of the printheads and poor print quality. Most notably, print quality is much lower on printers incorporating stationary ink jet printheads since deviations in ink jet nozzle directionality causes striations in the printed image. Striations may also be caused by clogged or damaged nozzles that will not eject droplets of ink when energized. Inoperative nozzles are especially detrimental when printing machine readable symbologies such as horizontally oriented bar codes since bar and space widths may be inadvertently altered.

The limitations of ink jet technology in on-demand printers described heretofore can be eliminated by using a disposable scanning ink jet printhead and interleaving algorithms which are well known in the art and described in U.S. Pat. No. 5,686,944. Such disposable scanning ink jet printhead, in a preferred embodiment, may have an ink reservoir thereon. Using a disposable ink jet printhead reduces the risk of printhead damage and increases printer robustness because the printheads can be periodically and inexpensively replaced before or immediately after damage to the printhead. A disadvantage to scanning ink jet printheads is the resulting reduction in print speed which limits their use in on-demand printing applications.

The multicolored printers discussed above have not been well accepted by consumers primarily because of excessive equipment costs in both the thermal transfer and ink jet printer types, consumables costs in the case of thermal transfer printers, and low print quality and reliability in the case of stationary ink jet printers.

For the foregoing reasons, an on-demand color printing apparatus is needed that can be manufactured at a low cost; leverages the quality and durability of thermal transfer printing when printing machine readable symbologies and other critical indicia; leverages the high print speed of thermal transfer printing when only monochrome thermal transfer printing is required; leverages the print quality and reliability of ink jet printing using scanning ink jet printheads; and has the efficiency and environmental friendliness of ink jet technology for printing multicolored indicia when desired on a print medium without causing a major reduction in print speed for most image formats. The present invention provides such a novel printing apparatus which presents these features and advantages and which overcomes the problems in the prior art. These will become apparent upon a reading of the attached specification in combination with an examination of the drawings.

OBJECTS AND SUMMARY OF THE INVENTION

It is a general object of the present invention to provide a novel and improved on-demand color printing apparatus which avoids the disadvantages of prior printers while affording additional structural and operating advantages.

Another general object of the present invention is to provide a novel printing apparatus which prints indicia on a print medium at a low cost, using a mixture of thermal transfer printing and ink jet printing.

An object of the present invention is to provide a novel printing apparatus which prints multicolored indicia on a print medium using a mixture of thermal transfer printing and ink jet printing without wasting excessive amounts of ribbon.

Another object of the present invention is to provide a novel printing apparatus which provides high speed monochrome printing on a print medium using thermal transfer printing only when multicolored indicia are not desired to be printed on the print medium.

It is a further object of the present invention to provide a novel printing apparatus which prints monochrome indicia on a print medium using thermal transfer printing and which prints a plurality of monochrome colored indicia on the print medium by using ink jet printing without causing a major reduction in print speed for most image formats.

It is an even further object of the present invention to provide a low cost and reliable printing apparatus for producing, on-demand, multicolor print images on a print medium using a thermal print station and an ink jet print station in a cooperating relationship that cooperatively render images on the print medium.

Briefly and in accordance with the foregoing, the present invention provides a novel on-demand multicolor printing apparatus for printing on a print medium. The printing apparatus includes a thermal transfer print station for printing a monochrome indicia on the print medium and for advancing the print medium along a path; an ink jet print station, incorporating disposable ink jet print heads, disposed in cooperating relationship to the thermal transfer print station for selective multicolor printing on the print medium; a decoupling station for decoupling the motion of the print medium between the thermal transfer print station and the ink jet print station, and a controller for processing and converting a serial data stream describing the indicia to be printed on the print medium into a form usable by both the thermal transfer print station and the ink jet print station and controlling the print stations to print the desired indicia on the print medium. The thermal transfer print station is used to print a single monochrome colored indica. The ink jet print station can be used to print a plurality of monochrome colored indicia or a single monochrome colored indicia.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT

Figure 1:
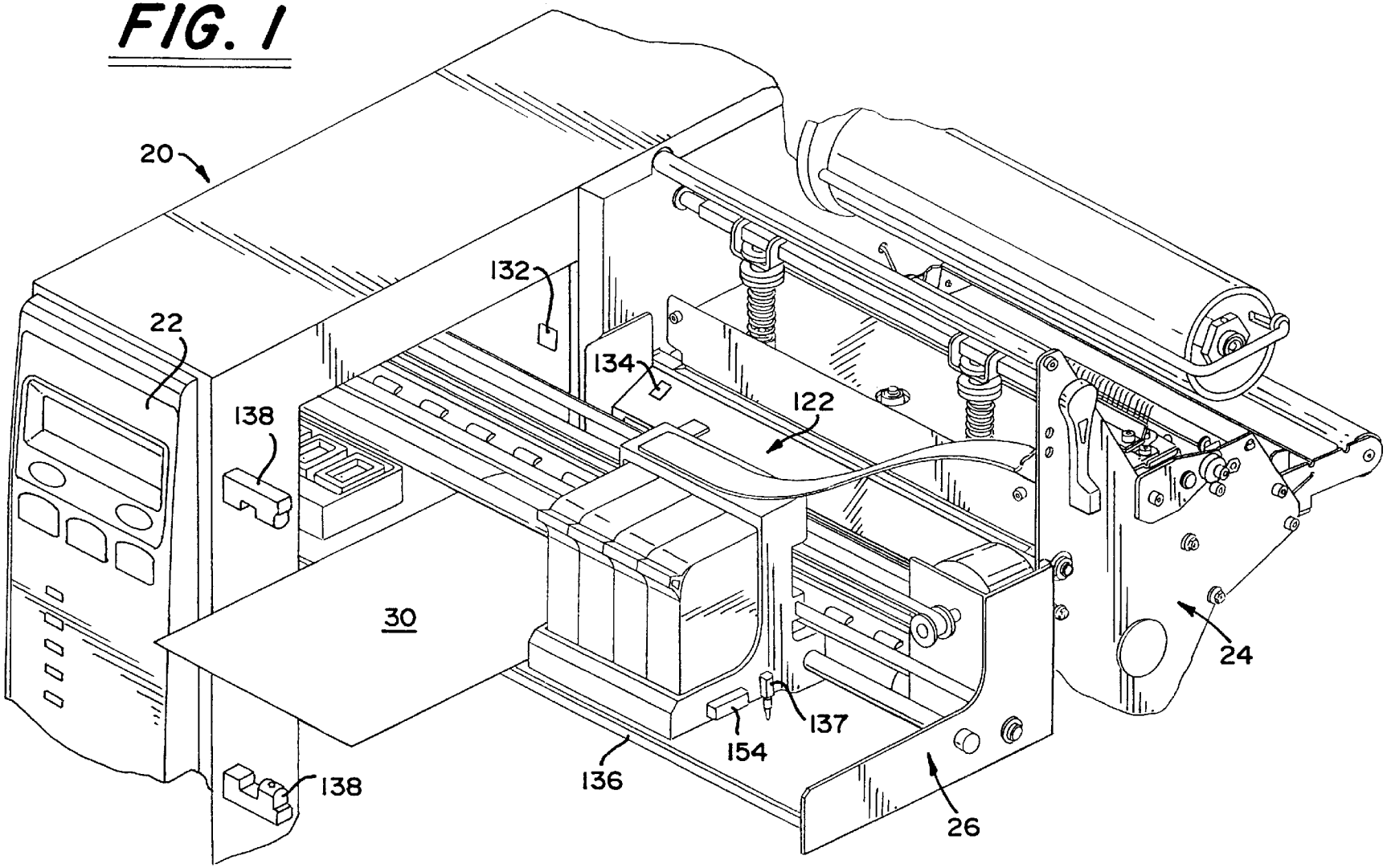
FIG. 1 is a partial perspective view of an on-demand multicolor printing apparatus which incorporates the features of the present invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

The on-demand multicolor printing apparatus 20 of the present invention is formed from a housing 22 having two different print stations 24, 26 therein. The print stations 24, 26 are operatively coupled together to print indicia 28, such as text, images, graphics and the like, on a print medium 30, such as a label, ticket, tag and the like. The indicia 28 may be monochrome or multicolored. Print station 24 is a thermal transfer print station and print station 26 is an ink jet print station. Each of the print stations 24, 26 are mounted to and within the housing 22 by suitable means. It is to be noted that the housing 22 is only partially shown in the drawings and one of ordinary skill would realize that the print stations 24, 26 are enclosed within the housing 22.

Figure 4:
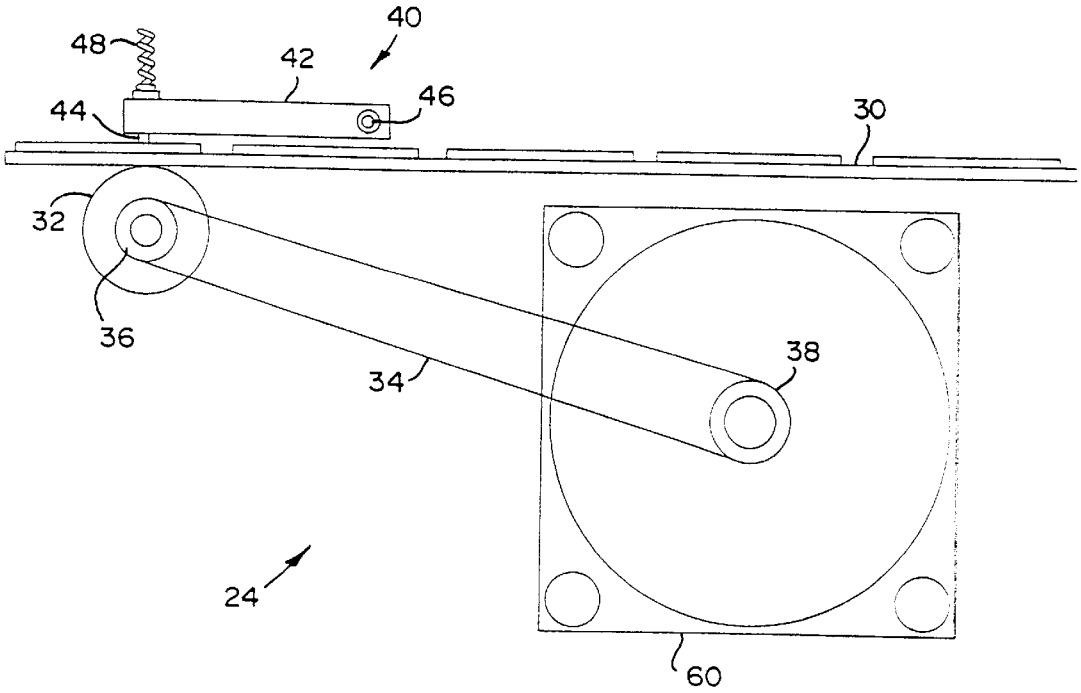
FIG. 4 is a side elevational view of a thermal transfer print station which forms part of the printing apparatus shown in FIG. 1.
Figure 5:
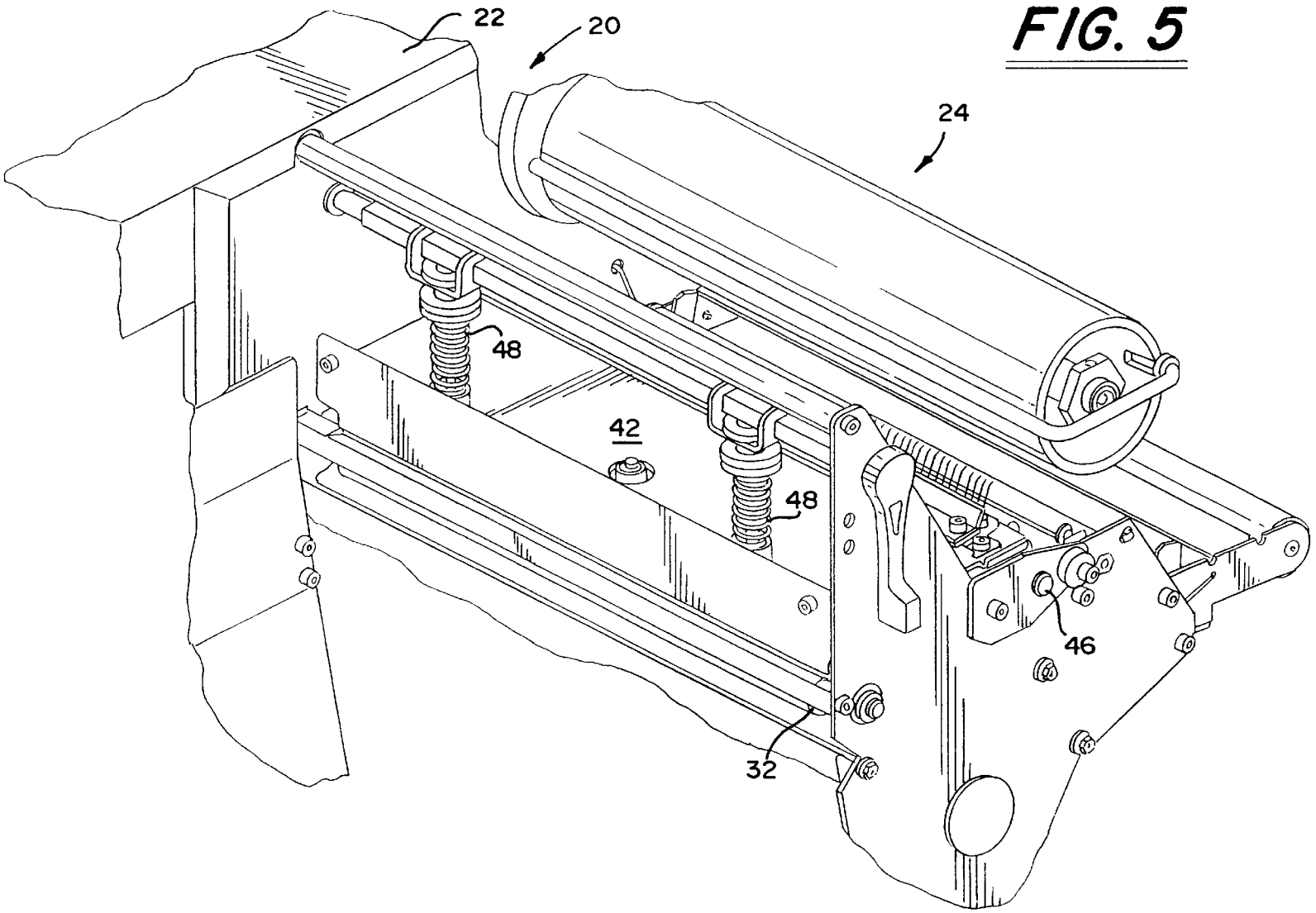
FIG. 5 is a perspective view, shown partially, of the thermal transfer print station attached to the printing apparatus housing.

The thermal transfer print station 24 is most clearly illustrated in FIGS. 4 and 5. The thermal transfer print station 24 is used to print indicia of a single monochromatic color on the print medium 30, for example the color black. The thermal transfer print station 24 includes a driving mechanism which is formed from a platen roller 32, driven by a stepper motor 60 through a belt and pulley drive assembly 34, 36, 38 to advance the print medium 30 therethrough in a conventional manner. The thermal transfer print station 24 further includes a thermal printhead assembly 40. The thermal printhead assembly 40 includes a conventional thermal transfer printhead 42 having a line of heater elements 44, such printhead 42 being positioned by a pivot 46 such that heater elements 44 are aligned transverse to the motion of the print medium 30. Heater elements 44 are pressed against the print medium 30 and the print medium 30 against platen roller 32 by the action of a bias mechanism 48 which also forms part of the thermal printhead assembly 40.

Figure 3:
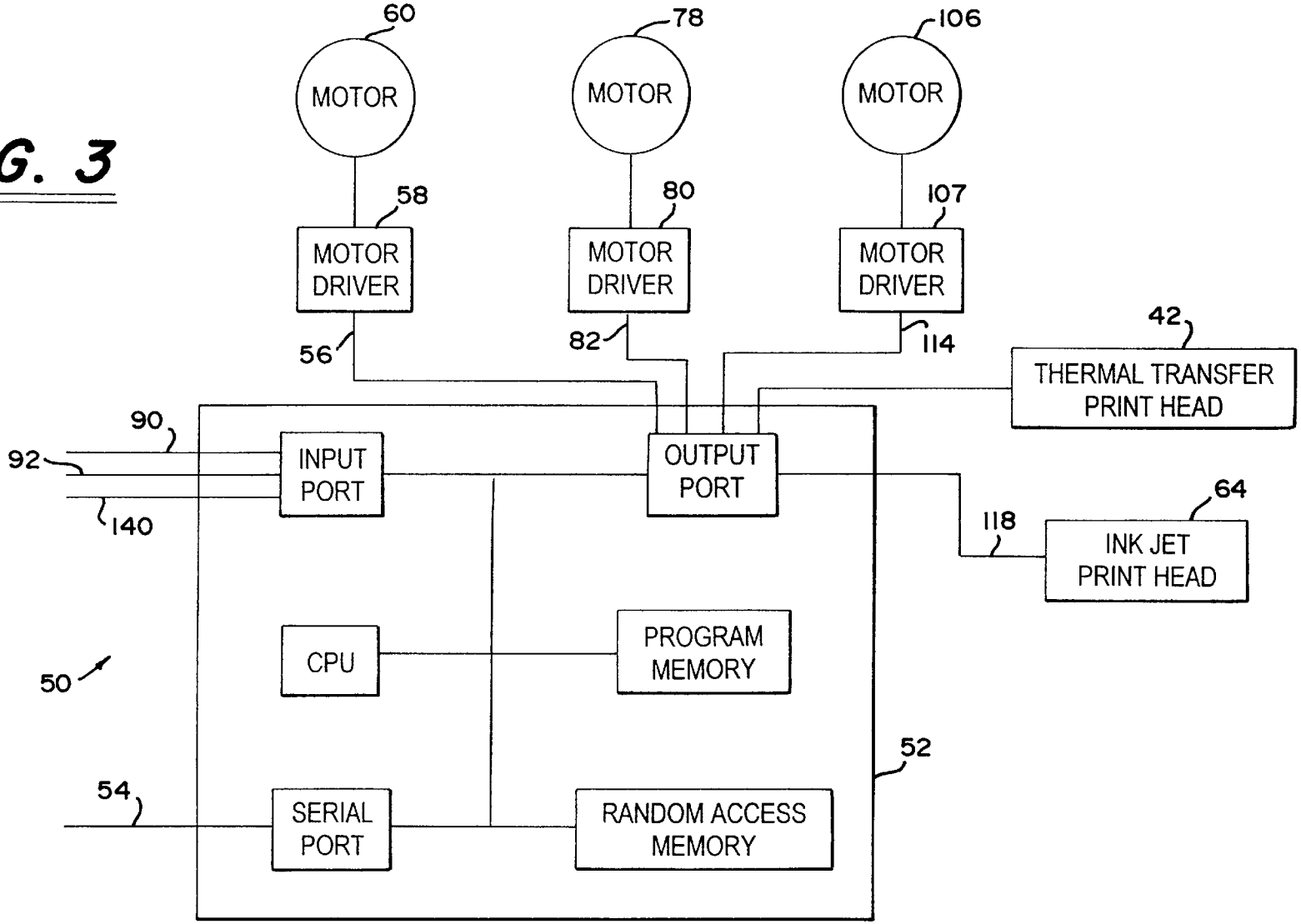
FIG. 3 is a partially schematic and partially functional block diagram of a microprocessor-based controller for the on-demand multicolor printing apparatus shown in FIG. 1.

FIG. 3 is a block diagram of a controller 50 for both the thermal transfer print station 24 and the ink jet print station 26. The controller 50 includes a microprocessor system 52 comprised of one or more integrated circuits having internal program memory, random access memory, a serial port responsive to a serial data input 54 for the receipt of information to be printed on the print medium 30, and input and output ports interconnected and operating in a manner well known in the art.

When information to be printed on the print medium 30 is transmitted to the serial data input 54 as a signal and when a signal is received by the controller 50 calling for a label, tag or ticket to be printed by the printing apparatus 20, the controller 50 begins pulsing line 56 to motor driver 58 in order to advance stepper motor 60. The rate in which the stepper motor 60 is pulsed is dependent on a number of factors that will be described hereinafter. Microprocessor system 52 then loads into thermal transfer printhead 42 image data representing selected heater elements 44 to be energized. Microprocessor 52 then energizes the selected heater element 44 by pulsing the thermal transfer printhead 42 to print a first row of dots. It then pulses line 56 to motor driver 58 again to advance stepper motor 60 by one dot row, thereby causing platen roller 32 to advance the print medium 30 in a conventional manner, and then repeats the printing process. This process continues until all of the information to be printed by the thermal transfer print station 24 on the print medium 30 has been completed, at which time controller 50 ceases printing and awaits the request for the next indicia to be printed.

Figure 6:
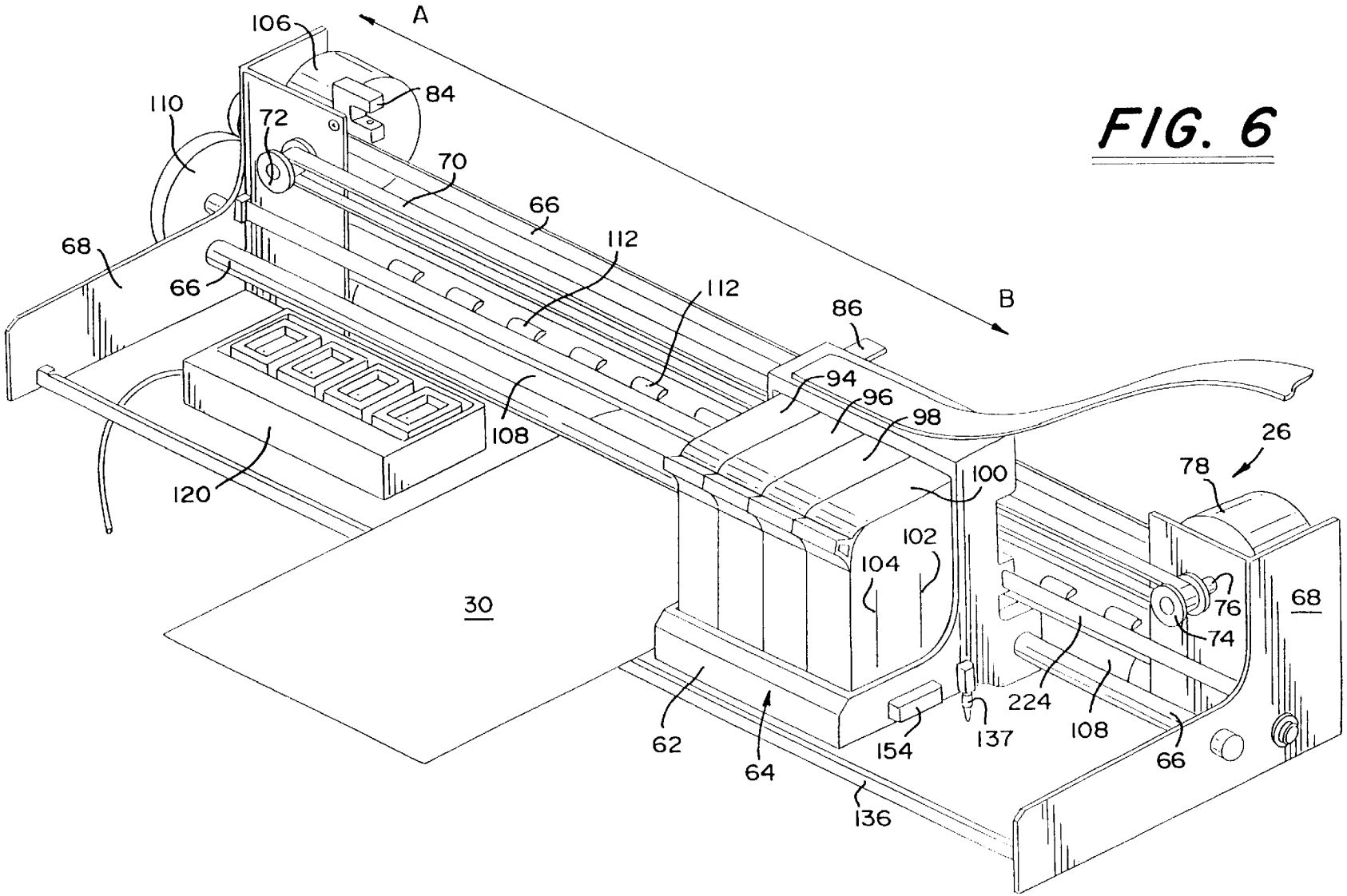
FIG. 6 is a perspective view of an ink jet print station which forms part of the printing apparatus shown in FIG. 1.

The ink jet print station 26 is most clearly illustrated in FIG. 6. The ink jet print station 26 is used to print indicia of a plurality of monochromatic colors or of a single monochromatic color. Preferably, the plurality of monochromatic colors or the single monochromatic color which are printed by the ink jet print station 26 is different than the monochromatic colored indicia printed by the thermal transfer print station 24. At times, however, it may be necessary for the ink jet print station 26 to print indicia that is the same monochromatic color as printed by the thermal transfer print station 24. This is normally required when the alignment between two different colored indicia on the print medium 30 is critical and where the color of one of the indicias is the same color as the color being printed by the thermal transfer print station 24. This action is required because the registration between the thermal transfer print station 24 and the ink jet print station 26 may not be exactly aligned and, furthermore, the printing resolutions of both print stations 24, 26 may not be identical. Likewise, perfect alignment of the two indicias printed by both print stations 24, 26 may be very difficult to obtain. In this latter case, it is preferable for the ink jet print station 26 to print the differently colored indicias to ensure perfect alignment.

A carriage 62 carrying an ink jet printhead assembly 64 thereon is supported on guide shafts 66 for sliding movement in the axial direction thereof. The guide shafts 66 are fixedly mounted to a frame 68. A timing belt 70 is coupled to the carriage 62 and extends between a pair of pulleys 72, 74, one of which, pulley 74, is coupled to an output shaft 76 of a carriage stepper motor 78. As seen in FIG. 3, stepper motor 78 is driven by motor driver 80 which is selectively pulsed by the microprocessor system 52 through line 82.

In FIG. 6, the rotation of the carriage stepper motor 78 causes, through a transmission mechanism provided by the pulleys 72, 74 and the timing belt 70, the carriage 62 to slide reversibly on the guide shafts 66 in the direction of arrow A or B in FIG. 6 across the print medium 30. Each movement of the carriage 62 in direction A or B is referred to as a "primary scan".

The reference position of the carriage 62 is detected by a home sensor 84 and associated flag 86. In addition, a linear encoder strip 88 is coupled to a linear encoder sensor (not shown) operatively placed on the carriage 62 for feedback of carriage movement by the carriage stepper motor 78. As shown in FIG. 3, the output of the home sensor 84 is fed into controller 50 through line 90 and the output of the linear encoder sensor 88 is fed into controller 50 through line 92 for processing of carriage position information by controller 50.

The ink jet printhead assembly 64 may be of any one of various liquid or solid jet types including thermal ink jet or piezo-electric ink jet. In the preferred embodiment, the ink jet printhead assembly 64 is of the disposable thermal ink jet type and is comprised of four separate and individually replaceable modules 94, 96, 98, 100 which are mounted on the carriage 62. Module 94 is filled with cyan ink; module 96 is filled with magenta ink; module 98 is filled with yellow ink; and module 100 is filled with black ink. Cyan, magenta, yellow and black ink are the commonly used colors when printing using subtractive color printing algorithms which are well known in the art and therefore, are not described herein.

Each module 94, 96, 98, 100 is formed from a plurality of nozzles (not shown) for ejecting ink on the print medium 30 when energized by heat, electric charge or acoustic waves depending on the printhead technology being used. Each of the nozzles in each module 94, 96, 98, 100 are equally spaced along an axis transverse to the axis of the primary scan. The distance along the transverse axis between the first position 102 of the nozzles and last position 104 of the nozzles along each printhead module 94, 96, 98, 100 is known hereinafter as the ink jet printhead's "swath."

In the ink jet print station 26, a second stepper motor 106 is coupled to an advancement roller 108 through gear set 110. The advancement roller 108 is spring loaded against bias rollers 112 for driving the print medium 30 therethrough in response to pulses on line 114 from microprocessor system 52 which causes rotation of the second stepper motor 106 using motor driver 107. The movement of the print medium 30 through rollers 108, 112 is referred to as a "secondary scan".

While the carriage 62 moves once in the direction A or B, the ink jet printhead assembly 64 is driven in response to an input signal from line 118 from the microprocessor system 25, whereby colored indicia 28 is printed on the print medium 30. In this embodiment, the print medium 30 must be absolutely stationary as the primary scan is in progress, therefore, a primary scan and a secondary scan cannot occur simultaneously.

After each primary-scan, a secondary scan takes place to advance the print medium 30 to the next print position. The next print position is determined by the quality of printing desired. In low quality mode, the secondary scan advancement length is the swath of the ink jet printhead assembly 64. In high quality mode, interleaved dot row printing is used requiring the secondary scan advancement length to be a sublength of the swath width of the ink jet printhead assembly 64, as is well know in the art of ink jet printing.

This process continues until all of the information to be printed on the print medium 30 has been completed, at which time the controller 50 ceases printing and awaits the request for the next ink jet image to be printed.

Periodically, the controller 50 moves the carriage 62 over to maintenance and capping station 120 to purge and wipe the ink jet printhead assembly 64 to ensure that the printhead nozzles are free of foreign debris. When the ink jet print station 26 is not printing, the controller 50 moves the carriage 62 over to the maintenance and capping station 120 to cap the ink jet printhead assembly 64 for preventing ink stored in the ink jet printhead assembly 64 from drying and clogging the printhead nozzles.

An important feature of this invention is to print indicia 28 on the print medium 30 using both the thermal transfer print station 24 and the ink jet print station 26. Combining both types of print stations 24, 26 is new in the art of on-demand color printers and complex since the advancement profiles of the print medium 30 through each type of print station 24, 26 differs.

To achieve optimal print quality in a thermal transfer printing, the velocity of the print medium 30 through the thermal transfer print station 24 needs to be continuous. In contrast, the velocity profile of the print medium 30 through the ink jet print station 26 is noncontinuous because the print medium 30 is required to be stationary during each primary scan. Therefore, a problem is created because the motion of the print medium 30 needs to be altered between the thermal transfer print station 24 and the ink jet print station 26.

Figure 2:
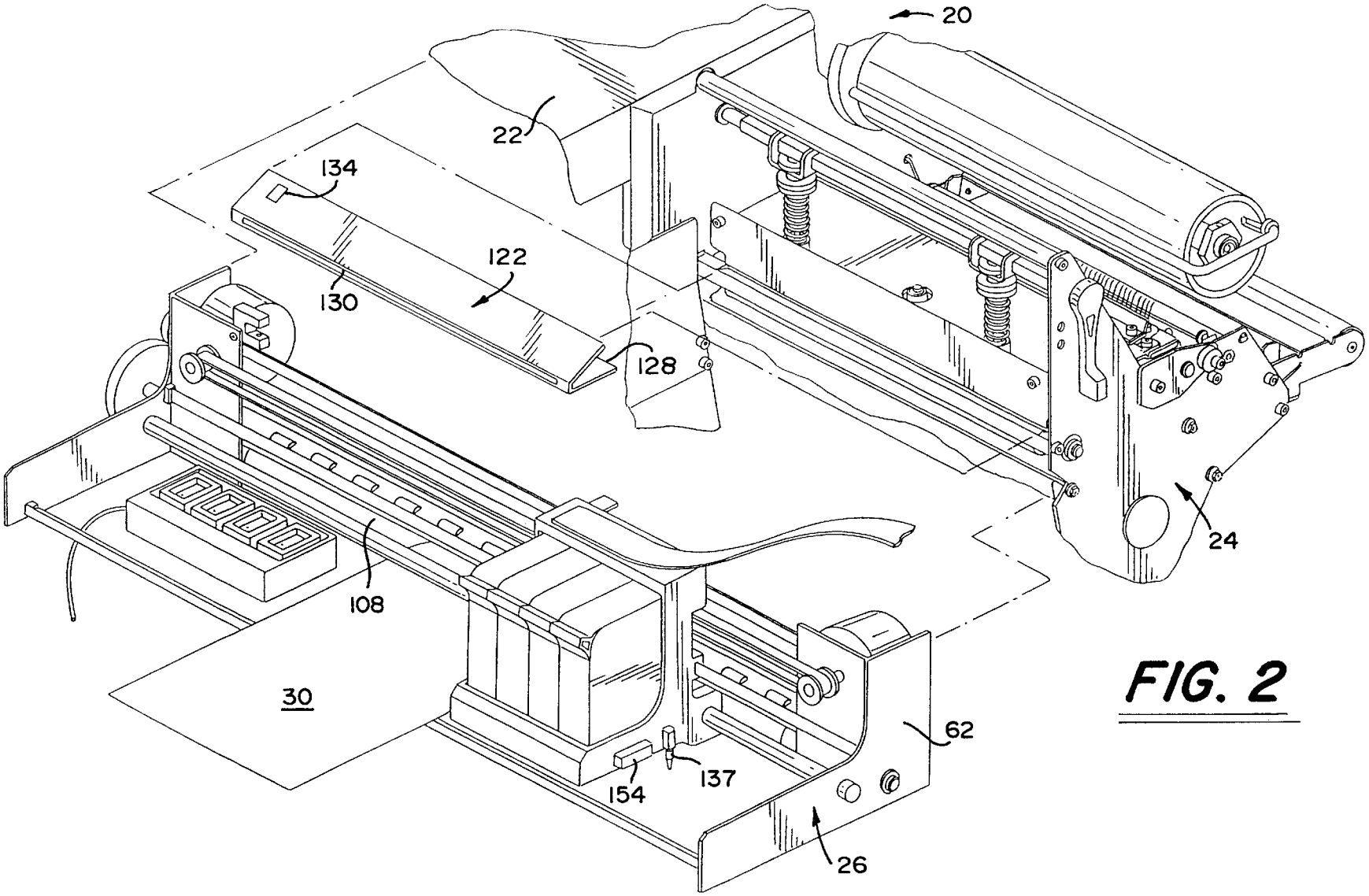
FIG. 2 is an partially exploded perspective view, shown partially, of the on-demand multicolor printing apparatus shown in FIG. 1.
Figure 7:
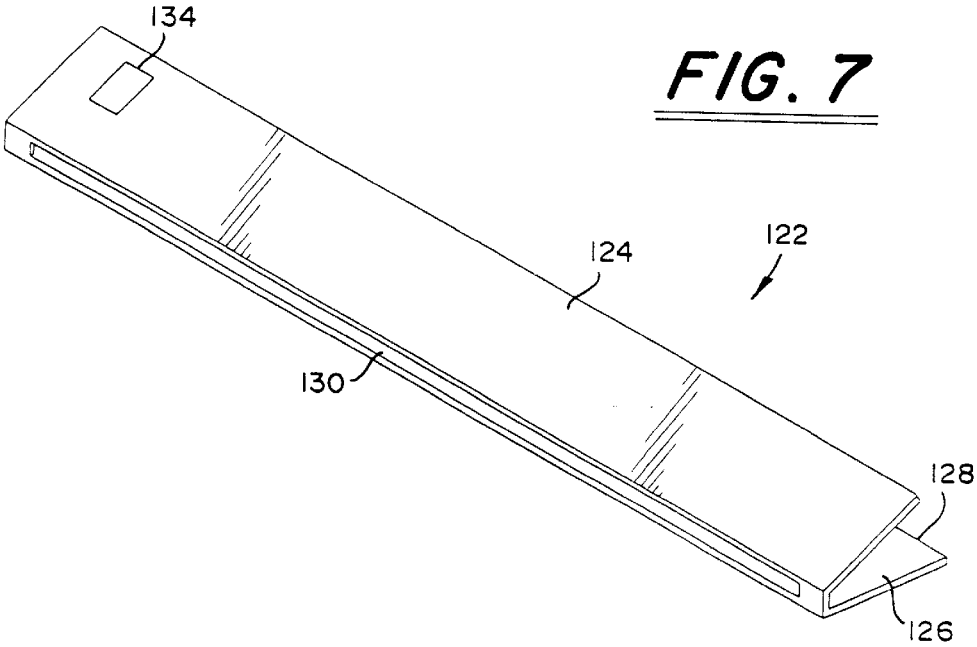
FIG. 7 is a perspective view of a decoupling station which forms part of the printing apparatus shown in FIG. 1.

To solve this problem, a decoupling of the motion between the thermal transfer print station 24 and the ink jet print station 26 is provided in the present invention, as best shown in FIG. 2 by using a decoupling station 122. FIG. 7 illustrates the decoupling station 122 in the preferred embodiment.

The decoupling station 122 is formed from a pair of flanges 124, 126 which are placed at an angle relative to each other. The decoupling station 122 is preferably mounted on the housing 22, but may be mounted on either the thermal transfer print station 24 or the ink jet print station 26 by suitable struts. An inlet port 128 is formed between the ends of the flanges 124, 126 which are farthest apart from each other and an exit port is formed between the ends of the flanges 124, 126 which are closest to each other. This allows the print medium 30 to pass therethrough.

In operation, the print medium 30 is advanced through the thermal transfer print station 24 under continuous motion and printed on in a single monochrome color by the thermal transfer printhead 42 as described hereinabove. The decoupling station 122 receives the print medium 30 through inlet port 128 and allows the print medium 30 to advance until the print medium 30 exits the decoupling station 122 through exit port 130 and contacts the advancement roller 108 of the ink jet print station 26. The contact of the print medium 30 with the advancement roller 108 is detected by a web sensor 132. An accumulation sensor 134 is operatively placed within decoupling station 122 to detect the amount of print medium 30 collected within the decoupling station 122. In the preferred embodiment, accumulation sensor 134 is of the acoustic type, however, other types of sensors may be used such as optical or mechanical.

The thermal transfer print station 24 continues to advance the print medium 30 until at least one ink jet printhead swath width plus the distance between exit port 130 of the decoupling station 122 and the last position 104 of the ink jet printhead nozzles has accumulated in the decoupling station 122 as detected by accumulation sensor 134. The print medium 30 accumulates between flanges 124, 126. When sufficient accumulation occurs in the decoupling station 122, the ink jet print station 26 performs a secondary scan of sufficient length to position the print medium 30 underneath the ink jet printhead assembly 64, where a primary scan is performed and printing commences. As the process is performed, the thermal transfer print station 24 continues to advance the print medium 30 into decoupling station 122.

When the primary scan is completed, the ink jet print station 26 initiates another secondary scan to reposition the print medium 30 underneath the ink jet printhead assembly 64, but only after at least one ink jet printhead swath of the print medium 30 has accumulated in decoupling station 122 to prevent the ink jet print station 26 from exerting tension on the print medium 30 which may cause misregistering of the print medium 30 in the thermal transfer print station 24.

This process continues until the entire thermal transfer indicia is printed on the print medium 30 by the thermal transfer print station 24. When this occurs, the ink jet print station 26 finishes printing the appropriate indicia 28 on the print medium 30. To complete the printing process, the thermal transfer print station 24 continues to advance the print medium 30, without printing on it, through the decoupling station 122, as described above, until the entire print medium 30 has passed through the printing apparatus 20 and been printed on by the ink jet print station 26.

The speed of the print medium 30 exiting the thermal transfer print station 24 is regulated by a control system (not shown) within the controller 50 using the quantity of the print medium 30 accumulation in the decoupling station 122 as an input and the angular velocity of the stepper motor 60 of the thermal transfer print station 24 as an output. In the preferred embodiment, the angular velocity of the stepper motor 60 is inversely proportional to the level of the print medium accumulation in the decoupling station 122 so that when a minimum amount of the print medium 30 is stored in the decoupling station 122, the angular velocity of the thermal transfer print station stepper motor 60 is at a maximum and vice versa. This control system works to keep the decoupling station 122 filled with the print medium 30 so that the ink jet print station 26 may run at maximum speed. It should be appreciated that other control systems external to controller 50 may alternatively be used to control the advancement rate of the print medium 30 into the decoupling station 122 such as PID control means among others.

After the print medium 30 has traversed both the thermal transfer print station 24 and the ink jet print station 26, the print medium 30 may be cut by a cutting module (not shown) placed downstream from ink jet print station 26 or may be torn off by the user on a tear bar 136. The cutting operation is controlled by the controller 50 through its output port (not shown) and the cutting or tearing operating is detected by a sensor 138, operatively placed near the cutting module or the tear bar 136 as best seen in FIG. 1. The sensor 138 is connected to the controller 50 through line 140. When the cut or tear is detected by the controller 50, the print medium 30 is advanced in a reverse direction so that the newly created leading edge on the print medium 30 just created by the cut or tear operation is positioned underneath the thermal printhead 42 of the thermal transfer print station 24 in anticipation of receipt by the controller 50 of new indicia to be printed onto the print medium 30. An optional cutter blade 137 may be placed on the carriage 62 to selectively cut the print medium 30 or, in the case of a label 142, to selectively die cut the label 142.

Figure 8:
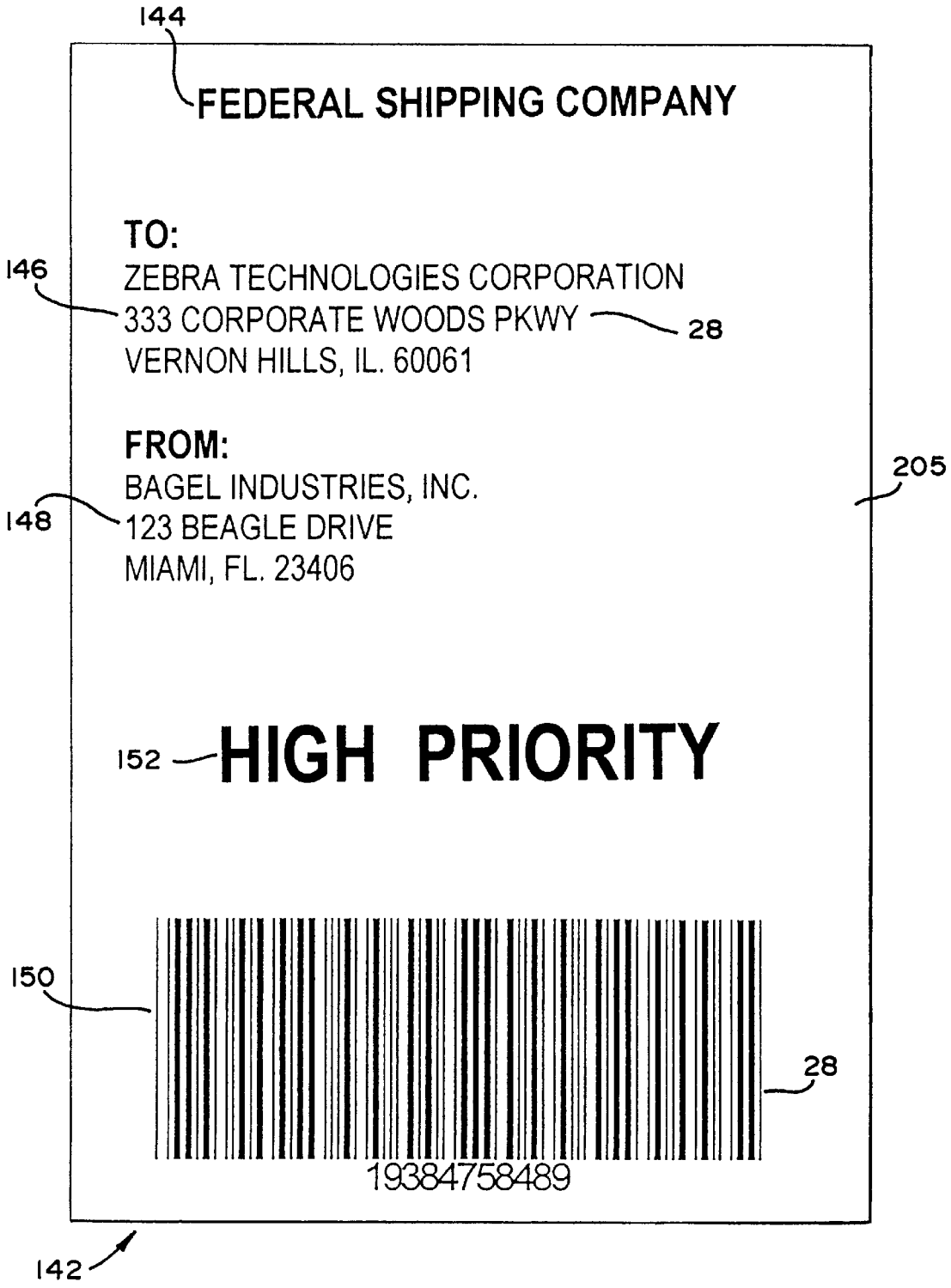
FIG. 8 is a top plan view of a label printed by the multicolor printing apparatus of the present invention.

The advantages to this invention may be best appreciated by referencing FIG. 8 showing a typical label 142 that could be printed by this new printing apparatus 20. In the following example, fields 144, 146, 148, 150 are desired to be printed in black ink and field 152 is desired to be printed in red ink to highlight the fact that the package that this label 142 is identifying has a high shipping priority.

Because fields 144, 146, 148 are printed in black ink and field 150, the barcode, should be printed at the highest possible print quality to increase its machine readability, these fields are rendered and transmitted by the controller 50 to the thermal transfer print station 24 for rapid and high quality printing. Because field 152 is printed in the color of red, controller 50 renders and transmits the bitmap image of field 152 to the ink jet print station 26 for printing in red ink.

The printing time of label 142 is quite fast because little time is required by the ink jet print station 26 to print field 152 in color. The label 142 is rapidly printed by the thermal transfer print station 24 and rapidly advanced through the ink jet print station 26, via the decoupling station 122, until the location of field 152 is placed within the swath underneath the ink jet printhead assembly 64 where the field 152 is printed. Immediately after field 152 is printed, the label 142 continues to rapidly advance in the manner described hereinabove until the label 142 exits the ink jet print station 26.

If the label 142 does not contain indicia which is to be printed by the ink jet print station 26, the entire label 142 could be printed by the thermal transfer print station 24. In this example, the label 142 is quickly printed by the thermal transfer print station 24 and rapidly advanced through the decoupling station 122 and the ink jet print station 26 until the label 142 exits the ink jet print station 26. In this case, the high print speed that thermal transfer printing affords is not compromised when indicia which is to be printed by the ink jet print station 26 is not printed on the print medium 30.

It should be appreciated that the printing apparatus 20 of the present invention is efficient and is environmentally friendly when printing multicolor indicia on the print medium 30 because only one thermal transfer ribbon is required and the ink jet print station 26 only deposits ink on the print medium 30 where required when printing multicolored indicia. To decrease the amount of ribbon wastage, prior art thermal transfer ribbon saving techniques may be used on the thermal transfer print station 24.

It should further be appreciated that the printing apparatus 20 of the present invention can be manufactured at a substantially lower cost than existing on-demand multicolor printers that incorporate more than two thermal transfer printheads, while allowing for a much larger gamut of colors to be printed. In addition, the printing apparatus 20 of the present invention can be manufactured at a substantially lower cost than existing on-demand multicolor printers that incorporate more than two stationary ink jet printheads, while allowing for a much larger gamut of colors to be printed.

It should also be appreciated that an optical or magnetic scanner module 154 can be placed on the carriage 62 of the ink jet print station 26 to capture the optical or magnetic image of the print medium 30 as the carriage 62 of the ink jet print station 26 traverses the print medium 30. This optical or magnetic image may be transmitted to the controller 50 for verifying that machine readable symbols or other critical indicia have been printed by either the thermal transfer print station 24 or the ink jet print station 26.

It should also be appreciated that other orientations of the multicolor printing apparatus 20 of the present invention could be achieved. For example, the cutter module could be placed between the thermal transfer print station 24 and the ink jet print station 26. Alteratively, the positions of the thermal transfer print station 24 and the ink jet print station 26 could be reversed.

While a preferred embodiment of the present invention is shown and described, it is envisioned that those skilled in the art may devise various modifications of the present invention without departing from the spirit and scope of the appended claims.

The invention claimed is:

1. A printing apparatus for printing indicia on a medium comprising: a housing; a thermal transfer printhead assembly mounted in said housing for printing a monochrome colored indicia on the medium; an ink jet printhead assembly mounted in said housing for printing at least one monochrome colored indicia on the medium; a decoupling means mounted between said thermal transfer printhead assembly and said ink jet printhead assembly for accumulating medium therein, and a sensor associated with said decoupling means for sensing the amount of medium accumulated in said decoupling means.

2. A printing apparatus as defined in claim 1, wherein said monochrome colored indicia printed by said ink jet printhead assembly is different in color than said monochrome colored indicia printed by said thermal transfer printhead assembly.

3. A printing apparatus as defined in claim 1, wherein said ink jet printhead assembly is used for printing a plurality of monochrome colored indicia on the medium, each of which are different in color than said monochrome colored indicia printed by said thermal transfer printhead assembly.

4. A printing apparatus as defined in claim 1, wherein said ink jet printhead assembly is used for printing a plurality of monochrome colored indicia on the medium, one of which is the same in color as said monochrome colored indicia printed by said thermal transfer printhead assembly.

5. A printing apparatus as defined in claim 1, wherein said decoupling means has a pair of flanges being angled relative to each other for accumulating medium therein and defining an inlet port and an exit port for allowing medium to pass between said flanges.

6. A printing apparatus as defined in claim 5, wherein said sensor is mounted on one of said flanges.

7. A printing apparatus as defined in claim 1, further including control means for controlling the passage of medium through said thermal transfer printhead assembly and said ink jet printhead assembly.

8. A printing apparatus as defined in claim 7, wherein said control means processes and converts a serial data stream describing the indicia to be printed on the medium into a form usable by both said thermal transfer printhead assembly and said ink jet printhead assembly and controls said thermal transfer printhead assembly and said ink jet printhead assembly to print the desired indicia on the medium.

9. A printing apparatus as defined in claim 1, further including a sensor for determining when the medium contacts said ink jet printhead assembly.

10. A printing apparatus as defined in claim 1, further including severing means for severing the medium.

11. A printing apparatus as defined in claim 1, further including cutting means for die cutting the medium.

12. A printing apparatus as defined in claim 1, further including a scanner placed on said ink jet printhead assembly for capturing the image of the medium as said ink jet printhead assembly traverses the medium.

13. A printing apparatus as defined in claim 12, wherein said scanner is an optical scanner for capturing the optical image of the medium.

14. A printing apparatus as defined in claim 12, wherein said scanner is a magnetic scanner for capturing the magnetic image of the medium.

15. A method of printing indica on a medium using a printing apparatus comprising the steps of:

providing a printing apparatus comprising a housing, a thermal transfer printhead assembly mounted in said housing for printing a monochrome colored indicia on the medium, an ink jet printhead assembly mounted in said housing for printing at least one monochrome colored indicia on the medium, a decoupling means mounted between said thermal transfer printhead assembly and said ink jet printhead assembly for accumulating medium therein, and a sensor associated with said decoupling means for sensing the amount of medium accumulated in said decoupling means;

providing a medium for passage through said thermal transfer printhead assembly, through said decoupling means, and through said ink jet printhead assembly;

printing a monochrome colored indicia on said medium using said thermal transfer printhead assembly;

allowing said medium to accumulate in said decoupling means until said sensor detected a predetermined amount of medium collected therein; and thereafter printing a monochrome colored indicia on said medium using said ink jet printhead assembly.

16. A method as defined in claim 15, wherein in said step of printing a monochrome colored indicia on said medium using said ink jet printhead assembly, said monochrome colored indicia printed by said ink jet printhead assembly is different in color than said monochrome colored indicia printed by said thermal transfer printhead assembly.

17. A method as defined in claim 15, wherein in said step of printing a monochrome colored indicia on said medium using said ink jet printhead assembly, said monochrome colored indicia printed by said ink jet printhead assembly is substantially the same in color as said monochrome colored indicia printed by said thermal transfer printhead assembly.

18. A method as defined in claim 15, further including the step of printing a plurality of monochrome colored indicia on said medium using said ink jet printhead assembly.

19. A method as defined in claim 18, wherein each said monochrome colored indicia printed by said ink jet printhead assembly is different in color than said monochrome colored indicia printed by said thermal transfer printhead assembly.

20. A method as defined in claim 18, wherein one of said monochrome colored indicia printed by said ink jet printhead assembly is substantially the same in color as said monochrome colored indicia printed by said thermal transfer printhead assembly.

21. A method as defined in claim 15, further including the step of sensing the position of said medium when said medium contacts said ink jet printhead assembly.

22. A method as defined in claim 15, further including the step of severing said medium after said medium has been printed on by said thermal transfer printhead assembly and said ink jet printhead assembly.

23. A method as defined in claim 15, further including the step of die cutting said medium after said medium has been printed on by said thermal transfer printhead assembly and said ink jet printhead assembly.

24. A method as defined in claim 15, further including the steps of providing control means for controlling the passage of medium through said thermal transfer printhead assembly, through said decoupling means, and through said ink jet printhead assembly, and using said control means to process and convert a serial data stream describing the indicia to be printed on said medium into a form usable by both said thermal transfer printhead assembly and said ink jet printhead assembly and to control said thermal transfer printhead assembly and said ink jet printhead assembly to print the desired indicia on said medium.

25. A method as defined in claim 15, further the steps of providing an optical scanner for capturing the optical image of said medium as said ink jet printhead assembly traverses said medium and using said scanner to capture said optical image.

26. A method as defined in claim 15, further the steps of providing a magnetic scanner for capturing the magnetic image of said medium as said ink jet printhead assembly traverses said medium and using said scanner to capture said magnetic image.

* * * * *

UNITED STATES PATENT AND TRADEMARK OFFICE

CERTIFICATE OF CORRECTION

PATENT NO. : 6,151,037
DATED : November 21, 2000
INVENTOR(S) : Jeffrey R. Kaufman, Jack LeVan, Clive Hohberger and Larry Ancahas.

It is certified that error appears in the above-identified patent and that said Letters Patent is hereby corrected as shown below:

Title page, item [75],
Inventors, "Clive Hohberger, Gurnee; Larry Ancahas, Glencoe" should read -- Clive Hohberger, Glencoe; Larry Ancahas, Gurnee" --

Signed and Sealed this

Second Day of October, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,151,037
APPLICATION NO. : 09/034443
DATED : November 21, 2000
INVENTOR(S) : Jeffrey R. Kaufman et al.

It is certified that error appears in the above-identified patent and that said Letters Patent is hereby corrected as shown below:

75 Inventors: "Clive Hohberger, Gurnee; Larry Ancahas, Glencoe" should read

-- Clive Hohberger, Glencoe; Larry Ancahas, Gurnee --

Signed and Sealed this

Fourth Day of September, 2007

JON W. DUDAS
*Director of the United States Patent and Trademark Office*